US011408276B2

(12) United States Patent
Jabari et al.

(10) Patent No.: US 11,408,276 B2
(45) Date of Patent: Aug. 9, 2022

(54) HYDROCARBON WELLS AND METHODS THAT UTILIZE A PLUG WITH AN INCLUDED TRACER MATERIAL

(71) Applicant: ExxonMobil Upstream Research Company, Spring, TX (US)

(72) Inventors: Rami Jabari, The Woodlands, TX (US); Maciej Lukawski, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 16/908,869

(22) Filed: Jun. 23, 2020

(65) Prior Publication Data

US 2021/0054733 A1 Feb. 25, 2021

Related U.S. Application Data

(60) Provisional application No. 62/889,746, filed on Aug. 21, 2019.

(51) Int. Cl.
*E21B 33/12* (2006.01)
*E21B 47/09* (2012.01)

(52) U.S. Cl.
CPC ..... *E21B 47/09* (2013.01); *E21B 33/12* (2013.01); *E21B 2200/08* (2020.05)

(58) Field of Classification Search
None
See application file for complete search history.

(56) References Cited

U.S. PATENT DOCUMENTS

2012/0175109 A1* 7/2012 Richard ..... E21B 43/11 166/250.12
2018/0087369 A1* 3/2018 Sherman ..... G01N 33/24
2018/0252067 A1* 9/2018 Fripp ..... E21B 33/1208
2020/0378242 A1* 12/2020 Jabari ..... E21B 33/12

* cited by examiner

*Primary Examiner* — Andrew Sue-Ako
(74) *Attorney, Agent, or Firm* — Leandro Arechederra, III

(57) ABSTRACT

Hydrocarbon wells and methods that utilize a plug with an included tracer material. The hydrocarbon wells include a wellbore that extends within a subsurface region and a downhole tubular that extends within the wellbore and defines a tubular conduit. The hydrocarbon wells also include a plug positioned within the wellbore and a tracer detection structure. The plug forms a fluid seal and includes a tracer material. The tracer detection structure is configured to detect the tracer material within a produced fluid stream that is produced from the hydrocarbon well. The methods include releasing the tracer material from the plug and producing the produced fluid stream. The methods also include detecting the tracer material within the produced fluid stream.

22 Claims, 4 Drawing Sheets

HYDROCARBON WELLS AND METHODS THAT UTILIZE A PLUG WITH AN INCLUDED TRACER MATERIAL

CROSS-REFERENCE TO RELATED APPLICATION

This application claims the benefit of U.S. Provisional Application 62/889,746 filed Aug. 21, 2019 entitled HYDROCARBON WELLS AND METHODS THAT UTILIZE A PLUG WITH AN INCLUDED TRACER MATERIAL, the entirety of which is incorporated by reference herein.

FIELD OF THE DISCLOSURE

The present disclosure relates generally to hydrocarbon wells and methods that utilize a plug with an included tracer material, and more particularly to hydrocarbon wells and methods that utilize the plug with the included tracer material to detect at least partial destruction of the plug.

BACKGROUND OF THE DISCLOSURE

Conventionally, coiled tubing is utilized to remove (e.g., to drill and/or mill out) plugs subsequent to completion operations. However, the reach of coiled tubing is limited. As such, dissolvable plugs are utilized within region(s) of the wellbore that are beyond the reach of coiled tubing. While the dissolvable plugs are effective in certain circumstances, it is difficult to definitively know if and/or when the plugs have dissolved. It also is difficult to determine whether or not undissolved plugs, or other materials, are obstructing the wellbore. Thus, there exists a need for hydrocarbon wells and methods that utilize a plug with an included tracer material that may be utilized to indicate destruction of the plug and/or obstruction of the hydrocarbon wells.

SUMMARY OF THE DISCLOSURE

Hydrocarbon wells and methods that utilize a plug with an included tracer material. The hydrocarbon wells include a wellbore that extends within a subsurface region and a downhole tubular that extends within the wellbore and defines a tubular conduit. The hydrocarbon wells also include a plug positioned within the wellbore and a tracer detection structure. The plug may form a fluid seal that fluidly isolates a region of the tubular conduit that is uphole from the fluid seal from a region of the tubular conduit that is downhole from the fluid seal. The plug also includes a tracer material. The tracer detection structure is configured to detect the tracer material within a produced fluid stream that is produced from the hydrocarbon well.

The methods include releasing the tracer material from the plug and producing the produced fluid stream from the hydrocarbon well. The releasing may be responsive to at least partial destruction of the plug. The produced fluid stream may include the tracer material. The methods also include detecting the tracer material within the produced fluid stream. The detecting may be performed by a tracer detection structure of the hydrocarbon well.

DETAILED DESCRIPTION AND BEST MODE OF THE DISCLOSURE

Figure 1:
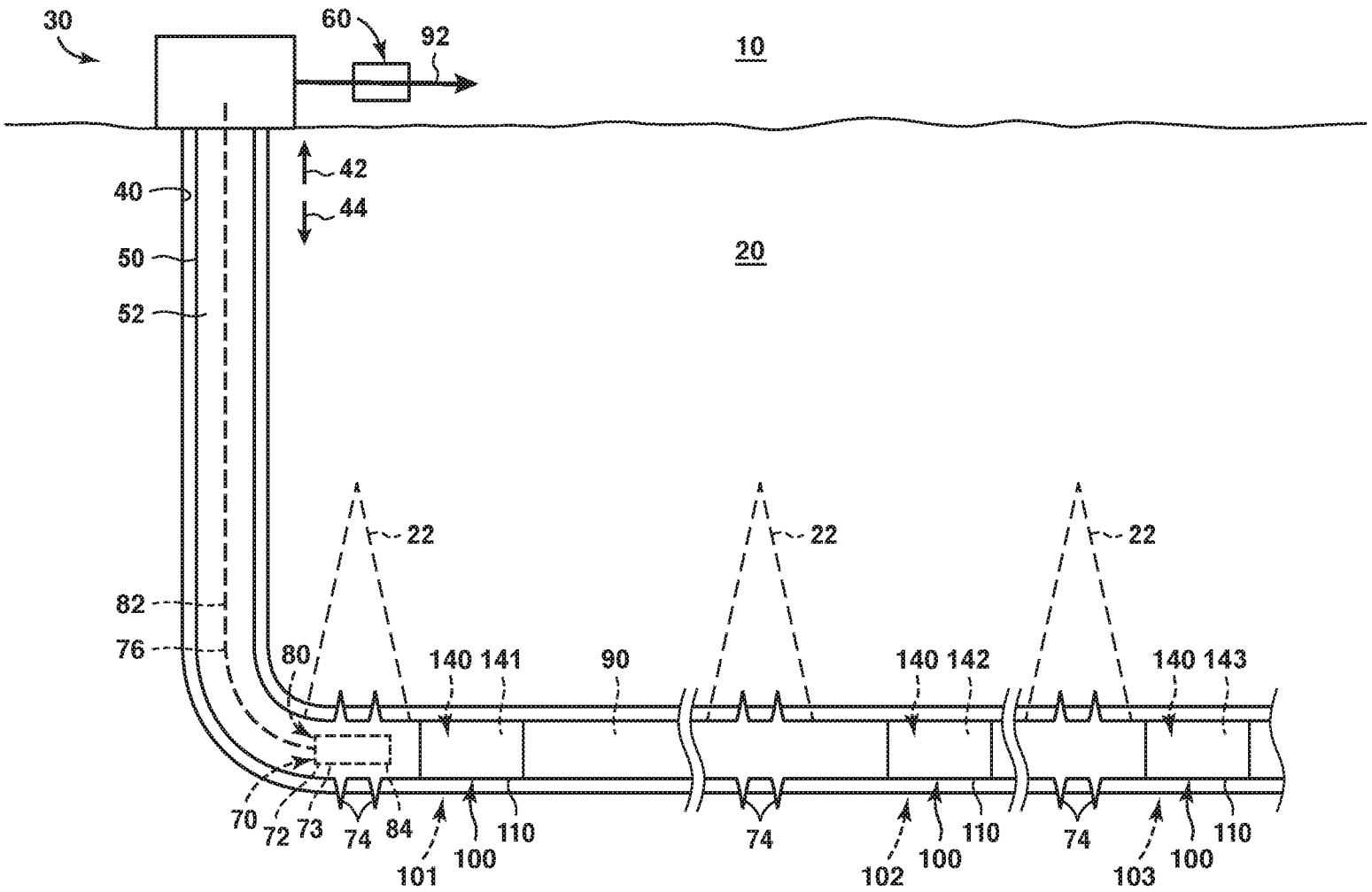
FIG. 1 is a schematic illustration of examples of hydrocarbon wells that may include a plug, according to the present disclosure.

FIGS. 1-7 provide examples of hydrocarbon wells 30, of plugs 100, and/or of methods 200, according to the present disclosure. Elements that serve a similar, or at least substantially similar, purpose are labeled with like numbers in each of FIGS. 1-7, and these elements may not be discussed in detail herein with reference to each of FIGS. 1-7. Similarly, all elements may not be labeled in each of FIGS. 1-7, but reference numerals associated therewith may be utilized herein for consistency. Elements, components, and/or features that are discussed herein with reference to one or more of FIGS. 1-7 may be included in and/or utilized with any of FIGS. 1-7 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic illustration of examples of hydrocarbon wells 30 that may include at least one plug 100, according to the present disclosure. As illustrated in FIG. 1, hydrocarbon wells 30 include a wellbore 40 that extends within a subsurface region 20. Wellbore 40 also may be referred to herein as extending between a surface region 10 and a subterranean formation that may be present and/or defined within the subsurface region. Hydrocarbon wells 30 also include a downhole tubular 50 that extends and/or that is positioned within wellbore 40 and defines a tubular conduit 52. Hydrocarbon wells 30 further include at least one plug 100 and a tracer detection structure 60.

Plugs 100 also may be referred to herein as frac plugs 100, as fracture plugs 100, and/or as downhole plugs 100. Plugs 100 form a fluid seal 110, such as with downhole tubular and/or with an internal surface of the downhole tubular. Fluid seal 110 fluidly isolates a region of tubular conduit 52 that is uphole (e.g., in an uphole direction 42) from the fluid seal from a region of the tubular conduit that is downhole (e.g., in a downhole direction 44) from the fluid seal. Plugs 100 include a tracer material 140.

Figure 7:
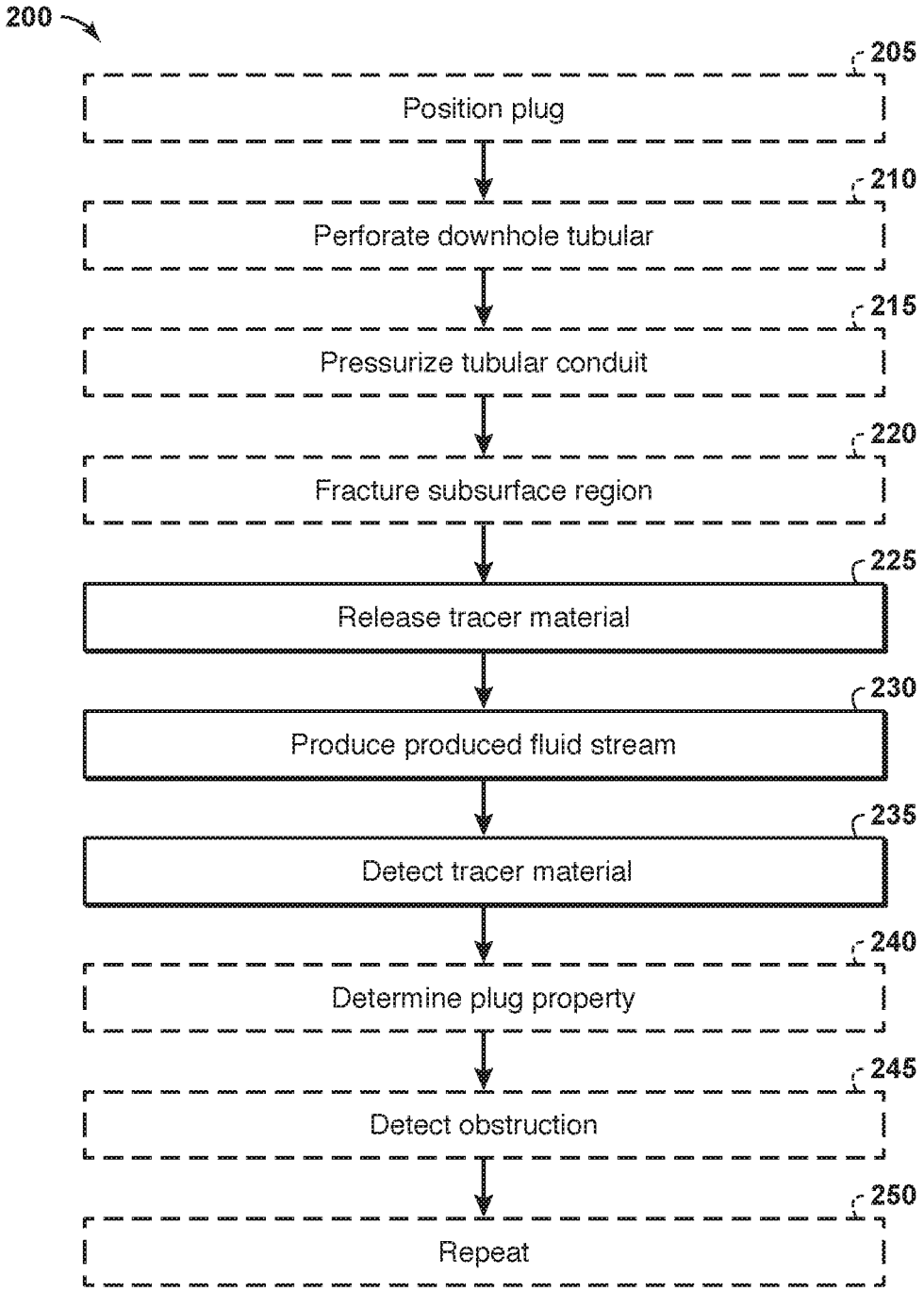
FIG. 7 is a flowchart illustrating examples of methods of operating a hydrocarbon well, according to the present disclosure.

During operation of hydrocarbon wells 30, and as discussed in more detail herein with reference to methods 200 of FIG. 7, tracer material 140 may be released from plugs 100 and/or into a wellbore fluid 90 that extends within wellbore 40. Released tracer material 140 and/or wellbore fluid 90 may flow from the hydrocarbon well and/or to the surface region in and/or within a produced fluid stream 92 that is produced from the hydrocarbon well. Tracer detection structure 60 may be configured to detect tracer material 140 within the produced fluid stream, and/or detection of the tracer material within the produced fluid stream may be utilized as an indicator of at least partial destruction of the plug that released the tracer material.

Tracer detection structure 60 may include any suitable structure that may be adapted, configured, designed, and/or constructed to detect tracer material 140 within produced fluid stream 92. This may include any suitable structure that may be configured to detect a presence of the tracer material within the produced fluid stream, to detect a concentration of the tracer material within the produced fluid stream, to detect a magnetic property of the tracer material within the produced fluid stream, and/or to detect an electrical property of the tracer material within the produced fluid stream.

As an example, tracer detection structure 60 may include and/or be a chemical detector that maybe configured to detect tracer material 140 based, at least in part, on a chemical identity of the tracer material that is within the produced fluid stream. As another example, tracer detection structure 60 may include and/or be a radiation detector that may be configured to detect radioactivity of, or released by, the tracer material that is within the produced fluid stream. As yet another example, tracer detection structure 60 may include and/or be a magnetic detector configured to detect a magnetic property of the tracer material that is within the produced fluid stream. As another example, tracer detection structure 60 may include and/or be an electrical detector configured to detect an electrical property of the tracer material that is within the produced fluid stream.

In some examples, and as illustrated in dashed lines in FIG. 1, hydrocarbon well 30 may include a perforation device 70, which may be positioned uphole from, or in uphole direction 42 from, a given plug 100, such as via a tether 76. Examples of perforation device 70 include a perforation gun 72 and/or a shaped charge perforation device 73.

As discussed in more detail herein, perforation device 70 may be adapted, configured, designed, and/or constructed to selectively perforate downhole tubular 50, such as to form one or more perforations 74 therein. Perforations 74 may provide fluid communication, or may permit fluid flow, between subsurface region 20 and tubular conduit 52. This may permit and/or facilitate formation of one or more fractures 22 within subsurface region 20, such as via fluid flow into the subsurface region via tubular conduit 52.

As also discussed in more detail herein, a plurality of plugs 100 and perforation device 70 together may be utilized to form a plurality of fractures 22 within a plurality of different, distinct, and/or spaced apart portions of subsurface region 20 in what may be referred to herein as a completion operation for hydrocarbon well 30. In such an example, and as illustrated in FIG. 1, at least one perforation 74, or a subset of the plurality of perforations 74, may be positioned between each adjacent pair of plugs 100.

When hydrocarbon well 30 includes a plurality of plugs 100, the plurality of plugs may be spaced-apart along a length of tubular conduit 52. Additionally or alternatively, each plug 100 may form a corresponding fluid seal 110 and/or each plug 100 may include a corresponding tracer material 140. As examples, in a hydrocarbon well 30 containing at least three plugs 100, a first plug 101 may include a first corresponding tracer material 141, a second plug 102 may include a second corresponding tracer material 142, and/or a third plug 103 may include a third corresponding tracer material 143. The first corresponding tracer material, the second corresponding tracer material, and/or the third corresponding tracer material may differ from one another and/or may exhibit at least one distinction, or property, that may be detected, or that may be detectable, by tracer detection structure 60. Thus, detection of a given corresponding tracer material by tracer detection structure 60 may be utilized to indicate which plug 100 released the given corresponding tracer material. It follows that this example may be extended to hydrocarbon wells 30 that include two distinct plugs 100 with first and second corresponding tracer materials 141, 142, as well as to hydrocarbon wells 30 with four or more such plugs 100 and respective corresponding tracer materials.

As an example, the corresponding tracer material of each plug may be chemically different from the corresponding tracer material of at least one, or even of each, other plug. As a more specific example, the first corresponding tracer material, the second corresponding tracer material, and/or the third corresponding tracer material may differ, or may be chemically different, from one another. In this example, tracer detection structure 60 may be configured to detect a chemical composition of the corresponding tracer material and/or to identify the plug that released the corresponding tracer material based, at least in part, on the chemical composition of the corresponding tracer material.

As another example, the corresponding tracer material of each plug may have a different concentration relative to the corresponding tracer material of at least one, or even of each, other plug. As a more specific example, the first corresponding tracer material may be present within the first plug at a first concentration, the second corresponding tracer material may be present within the second plug at a second concentration that may differ from the first concentration, and/or the third corresponding tracer material may be present within the third plug at a third concentration that may differ from the first concentration and/or from the second concentration. In this example, tracer detection structure 60 may be configured to detect the concentration of the corresponding tracer material within the produced fluid stream and/or to identify the plug that released the corresponding tracer material based, at least in part, on the concentration of the corresponding tracer material within the produced fluid stream. In this example, a chemical composition of the tracer material within two or more plugs may be similar, or even identical.

As yet another example, each plug may include a total mass of the corresponding tracer material. In this example, the total mass of the corresponding tracer material within each plug may differ from the total mass of the corresponding tracer material within at least one, or even every, other plug. As a more specific example, the first plug may include a first mass of the first corresponding tracer, the second plug may include a second mass of the second corresponding tracer material that may differ from the first mass, and/or the third plug may include a third mass of the third corresponding tracer material that may differ from the first mass and/or from the second mass. In this example, tracer detection structure 60 may be configured to detect the total mass of the corresponding tracer material within the produced fluid stream and/or to identify the plug that released the corresponding tracer material based, at least in part, on the amount, or the total mass, of the corresponding tracer material within the produced fluid stream. In this example, a chemical composition of the tracer material within two or more plugs may be similar, or even identical.

In some examples, and as also illustrated in dashed lines in FIG. 1, hydrocarbon well 30 may include a plug removal structure 80. Plug removal structure 80 may be adapted, configured, designed, and/or constructed to remove plug 100 from tubular conduit 52, such as to permit and/or facilitate fluid flow past the plug within the tubular conduit. In these examples, plug 100 may be configured to release tracer material 140 while, or responsive to, being milled to from the tubular conduit by the plug removal structure. An example of plug removal structure 80 includes a plug mill 84, which also may be referred to herein as a mill 84.

An umbilical 82, such as coiled tubing and/or a workover string, may support plug removal structure 80. The umbilical additionally or alternatively may be utilized to position the plug removal structure within the tubular conduit and/or may be utilized to power the plug removal structure during operation thereof.

Figure 2:
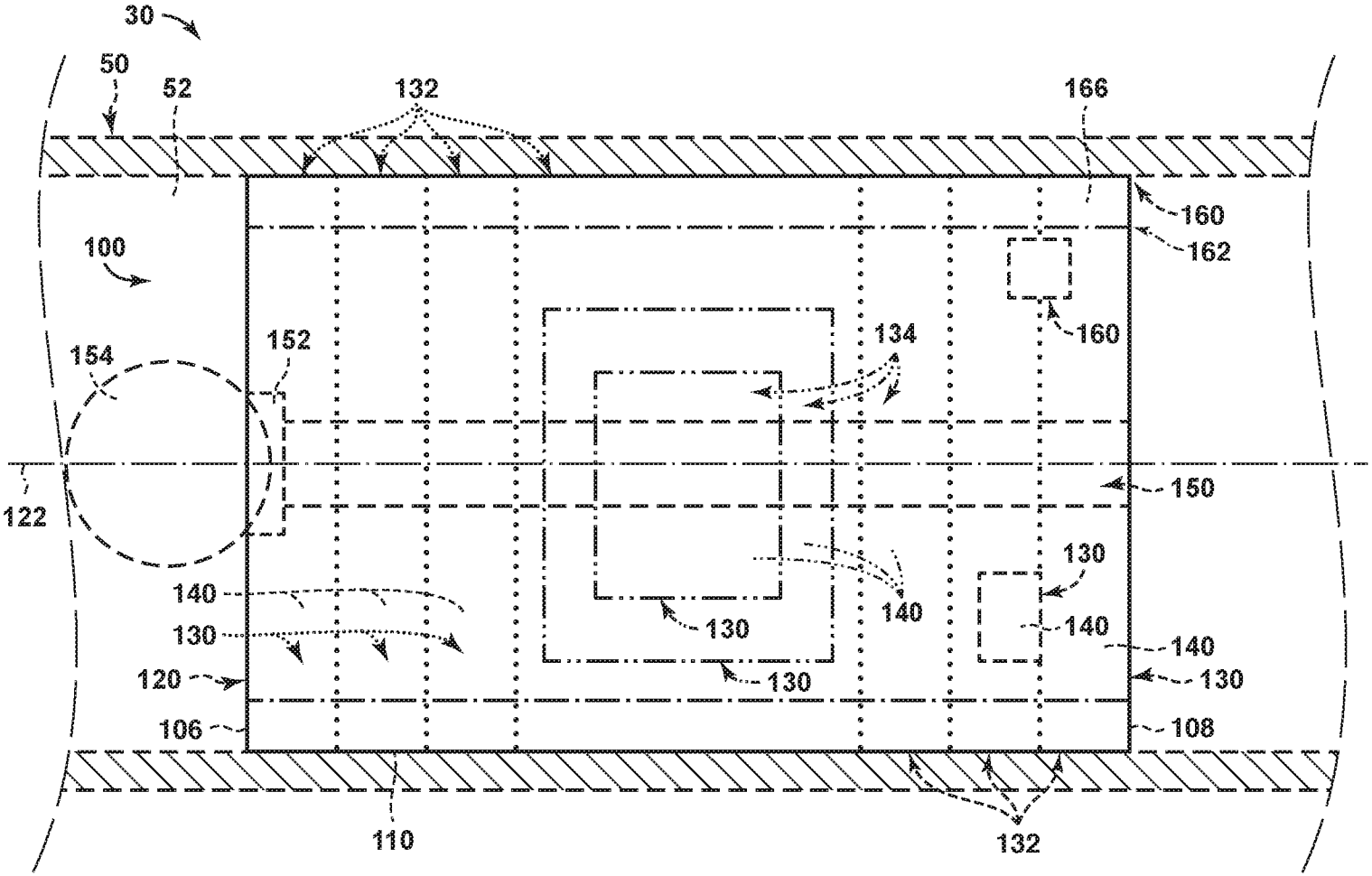
FIG. 2 is a schematic illustration of examples of a plug according to the present disclosure.

FIG. 2 is a schematic illustration of examples of a plug 100 according to the present disclosure. FIGS. 3-6 are less schematic illustrations of examples of plugs 100 according to the present disclosure. FIGS. 2-6 may be less schematic and/or more detailed illustrations of plugs 100 that are illustrated in combination with hydrocarbon wells 30 of FIG. 1. With this in mind, any of the structures, functions, and/or features that are disclosed herein with reference to plugs 100 of FIGS. 2-6 may be included and/or utilized with hydrocarbon wells 30 and/or plugs 100 of FIG. 1 without departing from the scope of the present disclosure. Similarly, any of the structures, functions, and/or features of that are disclosed herein with reference to hydrocarbon wells 30 and/or plugs 100 of FIG. 1 may be included in and/or utilized with plugs 100 of FIGS. 2-6 without departing from the scope of the present disclosure. Plugs 100 may include any suitable structure that may be positioned within tubular conduit 52, that may form fluid seal 110 with the tubular conduit, that may include tracer material 140, and/or that may release tracer material 140.

In some examples, plugs 100 may include and/or be a soluble plug that may be configured to dissolve, to at least partially dissolve, to completely dissolve, to be at least partially destroyed, and/or to be completely destroyed upon and/or responsive to fluid contact with wellbore fluid 90. In these examples, the soluble plugs may be configured such that dissolution of the soluble plugs causes the soluble plugs to release tracer material 140. Stated another way, release of tracer material 140 may be responsive to and/or a result of dissolution of the soluble plugs.

Examples of wellbore fluids 90 that may dissolve, or that may initiate dissolution of, plugs 100 include water, an aqueous solution, and/or a hydrocarbon fluid. Examples of plug materials, which may be soluble within wellbore fluids 90 and/or from which plugs 100 may be formed, include a water-soluble material configured to dissolve upon contact with the wellbore fluid, a water-soluble polymer, polyglycolic acid (PGA), and/or polylactic acid (PLA). Soluble plugs additionally or alternatively may include a corrodible material that may, or that may be configured to, corrode upon contact with the wellbore fluid. Examples of such corrodible materials include a corrodible metal, aluminum, and/or magnesium.

In some examples, plugs 100 may include and/or be millable plugs that may be configured to be mechanically milled from the tubular conduit, to be mechanically broken apart within the tubular conduit, to be mechanically removed from the tubular conduit, to be mechanically destroyed within the tubular conduit, and/or to be at least partially mechanically destroyed within the tubular conduit. Stated another way, the millable plugs may be configured to resist dissolution within wellbore fluid 90 and instead to be removed from the tubing conduit utilizing a mechanical removal tool, such as plug removal structure 80. However, this is not required of all examples, and it is within the scope of the present disclose that a given plug may include and/or be both a soluble plug and a millable plug.

Plugs 100 may include, may be defined by, and/or may be at least partially defined by a plug body 120. In some examples, plug body 120 may form and/or define an entirety of a given plug 100. In other examples, plug body 120 may form and/or define a fraction of the plug and one or more other plug structures may form and/or define a remainder of the plug. As an example, plug body 120 may be soluble within wellbore fluid 90, while the one or more other plug structures may be insoluble within the wellbore fluid. In such an example, dissolution of plug body 120 may produce, may generate, and/or may be referred to herein as at least partial destruction of plug 100. Examples of the fraction of the plug include at least 10%, at least 20%, at least 30%, at least 40%, at least 50%, at least 60%, at least 70%, at least 80%, at most 99%, at most 90%, at most 80%, at most 70%, at most 60%, at most 50%, at most 40%, and/or at most 30% of an overall volume of the plug.

Figure 3:
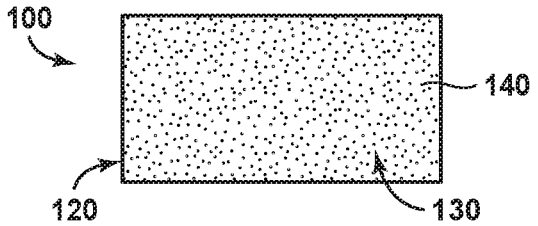
FIG. 3 is a less schematic illustration of an example of a plug according to the present disclosure.
Figure 4:
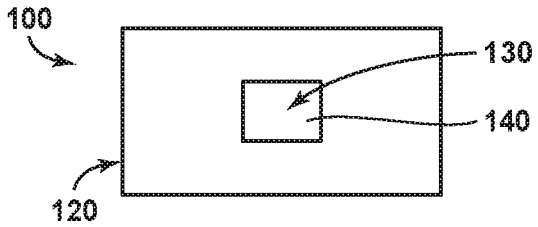
FIG. 4 is a less schematic illustration of an example of a plug according to the present disclosure.

In some examples, and as illustrated in FIGS. 2-3, tracer material 140 may be distributed throughout, may be at least substantially homogeneously distributed throughout, and/or may be homogeneously distributed throughout plug body 120 and/or an entirety of plug 100. Stated another way, an entirety of plug body 120 may include tracer material 140.

In some examples, plug body 120 may include a tracer-containing region 130 that may include, consist of, or consist essentially of tracer material 140. In these examples, and as illustrated in dashed lines in FIG. 2 and in solid lines in FIG. 4, tracer-containing region 130 may be localized within a given, or a selected, region and/or portion of plug 100 and/or of plug body 120. Stated another way, tracer-containing region 130 may be formed and/or defined within a subset of plug body 120.

In some examples, the tracer-containing region may be embedded and/or encapsulated in and/or within a remainder of the plug body. Such a configuration may permit and/or facilitate release of tracer material 140 subsequent to destruction and/or dissolution of the remainder, or of at least a region of the remainder, of the plug body. As an example, tracer-containing region 130 may be positioned within plug body 120 such that at least a threshold fraction of the plug body dissolves prior to exposure of the tracer material to the wellbore fluid and/or prior to release of the tracer material into the wellbore fluid. Examples of the threshold fraction of the plug body include at least 10%, at least 20%, at least 30%, at least 40%, at least 50%, at least 60%, at least 70%, at least 80%, at most 95%, at most 90%, at most 80%, at most 70%, at most 60%, and/or at most 50% of an overall volume of the plug body.

In some examples, the tracer-containing region may form and/or define an external surface of the plug body. Such a configuration may permit and/or facilitate release of the tracer material responsive to, or responsive to initiation of, dissolution of the plug body.

In some examples, tracer material 140 may include a tracer-containing solid that may be positioned within and/or that may define the tracer-containing region. In these examples, the tracer-containing solid may be soluble in wellbore fluid 90 and/or may be configured to dissolve within the wellbore fluid. Such dissolution may be relatively slower, may be more controlled, and/or may cause a concentration of the tracer material within produced fluid stream 92 to rise and fall over a period of time. As examples, dissolution of the tracer-containing solid may occur over a time period of at least 1 minute, at least 2 minutes, at least 5 minutes, at least 10 minutes, at least 15 minutes, at least 30 minutes, at least 45 minutes, and/or at least 60 minutes.

In some examples, tracer material 140 may include a tracer-containing liquid, which may be encapsulated in and/or within the remainder of the plug body. In these examples, dissolution of the remainder of the plug body may permit and/or facilitate release of the tracer-containing liquid into the wellbore fluid. Such release may be relatively faster and/or may cause a high-concentration slug of tracer material to be produced within produced fluid stream 92 of FIG. 1. As examples, release of the tracer-containing liquid may occur over a time period of at most 5 minutes, at most 4 minutes, at most 3 minutes, at most 2 minutes, at most 1 minute, at most 45 seconds, at most 30 seconds, at most 15 seconds, at most 10 seconds, and/or at most 5 seconds.

Figure 5:
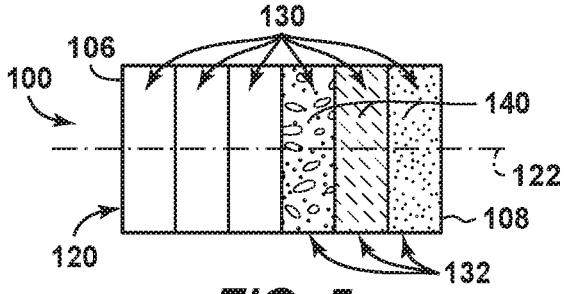
FIG. 5 is a less schematic illustration of an example of a plug according to the present disclosure.

In some examples, and as illustrated in dotted lines in FIG. 2 and in solid lines in FIG. 5, plug body 120 may include, have, and/or define a plurality of tracer-containing layers 132. Each tracer-containing layer 132 may be referred to herein as a tracer-containing region 130 and may include a corresponding tracer material 140. In some examples, each tracer-containing layer 132 may include a different and/or a distinct tracer material composition and/or concentration, such as may be independently detected and/or identified by tracer detection structure 60 of FIG. 1. Such a configuration may permit and/or facilitate determination of which tracer-containing layer 132 of the plurality of tracer-containing layers currently is releasing the corresponding tracer material 140.

In some examples, tracer-containing layers 130 may be flat and/or planar tracer-containing layers. In some examples, tracer-containing layers 132 may be arranged and/or positioned on an uphole plug end 106 of plug 100. In some examples, tracer-containing layers 132 may be arranged and/or positioned on a downhole plug end 108 of plug 100. In some examples, tracer-containing layers 132 may be arranged and/or distributed throughout an entirety of plug 100 and/or of plug body 120. In some examples, tracer-containing layers 132 may be arranged and/or distributed sequentially along an elongate axis 122 of plug 100 and/or of plug body 120.

Figure 6:
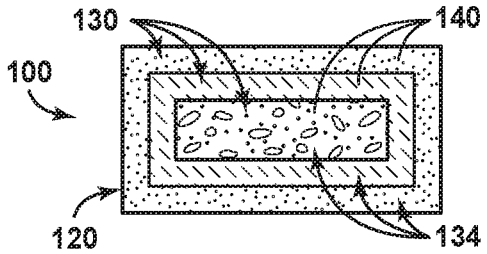
FIG. 6 is a less schematic illustration of an example of a plug according to the present disclosure.

In some examples, and as illustrated in dash-dot-dot lines in FIG. 2 and in solid lines in FIG. 6, plug body 120 may include, and/or tracer-containing layers 132 may be arranged in, a plurality of tracer-containing shells 134. Each tracer-containing shell 134 may be referred to herein as a tracer-containing region 130 and may include a corresponding tracer material 140. In some examples, each tracer-containing shell 134 may include a different and/or a distinct tracer material composition and/or concentration, such as may be independently detected and/or identified by tracer detection structure 60 of FIG. 1. Such a configuration may permit and/or facilitate determination of which tracer-containing shell 134 of the plurality of tracer-containing layers currently is releasing the corresponding tracer material 140. As illustrated, at least one tracer-containing shell 134 may cover, may coat, and/or may encapsulate at least one other tracer-containing shell 134.

Tracer material 140 may include any suitable structure and/or material that may form a portion of plug 100, that may be selectively released from plug 100 upon at least partial destruction of the plug, and/or that may be detected by tracer detection structure 60 and/or within produced fluid stream 92. As an example, tracer material 140 may include and/or be a material that is not naturally present, or that is not naturally occurring, within subsurface region 20. As another example, tracer material 140 may include and/or be a material that is not included in and/or that does not define conventional plugs for conventional hydrocarbon wells. As yet another example, tracer material 140 may be incorporated, into plug 100, at a concentration and/or with a total mass that causes the concentration of tracer material 140 within produced fluid stream 92 to exceed a natural concentration of the tracer material that may be present within the produced fluid stream when the tracer material is not released from the plug and/or when the tracer material naturally is produced from the subsurface region. As examples, the concentration of tracer material within the produced fluid stream may be at least 5, at least 10, at least 25, at least 50, at least 100, at least 250, at least 500, and/or at least 1000 times higher when the tracer material is released from the plug when compared to the natural concentration of the tracer material within the produced fluid stream.

In some examples, the tracer material may include and/or have a chemical composition that differs from a plug composition of a remainder of the plug and/or of a conventional plug. In some examples, the tracer material may include a chemical composition that is readily detectable by tracer detection structure 60 and/or that is detectable at low concentrations by tracer detection structure 60.

As more specific examples, the tracer material may include and/or be a magnetic tracer material, a phase shift tracer material, and/or a radioactive tracer material. When the tracer material includes the magnetic tracer material, tracer detection structure 60 may be configured to detect a magnetic property of the magnetic tracer material. When the tracer material includes the phase shift tracer material, tracer detection structure 60 may be configured to detect a phase shift in an electromagnetic field that is caused by an interaction between the electromagnetic field and the phase shift tracer material. When the tracer material includes the radioactive tracer material, tracer detection structure 60 may be configured to detect radioactivity of the radioactive tracer material.

In some examples, tracer material 140 may be configured to dissolve and/or to disperse in and/or within wellbore fluid 90. Examples of such tracer materials may include water-based tracer materials, water-soluble tracer materials, oil-based tracer materials, and/or oil-soluble tracer materials.

Turning to FIG. 2, and as discussed, plug 100 may include uphole plug end 106 and downhole plug end 108. As illustrated in dashed lines in FIG. 2, plug 100 also may include a through hole 150, which may extend between the uphole plug end and the downhole plug end. In these examples, plug 100 also may include a frac ball seat 152, which also may be referred to herein as a ball sealer seat 152, that may be define on uphole plug end 106. Frac ball seat 152 may be configured to receive a frac sealer 154, which also may be referred to herein as a ball sealer 154. Receipt of the frac sealer may restrict fluid flow, via through hole 150, from uphole plug end 106 and/or toward downhole plug end 108.

As also illustrated in dashed lines in FIG. 2, plug 100 may include an actuation mechanism 160. Actuation mechanism 160 may be configured to selectively transition plug 100 from a disengaged state 162, which is illustrated in dash-dot lines in FIG. 2, to an engaged state 164, which is illustrated in solid lines in FIG. 2. When in disengaged state 162, plug 100 may be configured, or may be free, to move within tubular conduit 52 and/or may not form fluid seal 110 with downhole tubular 50. In contrast, when in engaged state 164, plug 100 may operatively engage downhole tubular 50, may resist motion within tubular conduit 52, and/or may form fluid seal 110. An example of actuation mechanism 160 includes an expansion structure 166 configured to expand to operatively engage the downhole tubular.

FIG. 7 is a flowchart illustrating examples of methods 200 of operating a hydrocarbon well, such as hydrocarbon well 30 of FIG. 1, according to the present disclosure. The hydrocarbon well includes a wellbore that extends within a subsurface region and a downhole tubular that extends within the wellbore and defines a tubular conduit. The hydrocarbon well also includes a plug that is positioned within the tubular conduit.

Methods 200 may include positioning the plug at 205, perforating the downhole tubular at 210, pressurizing the tubular conduit at 215, and/or fracturing the subsurface region at 220. Methods 200 include releasing a tracer material at 225, producing a produced fluid stream at 230, and detecting the tracer material at 235. Methods 200 also may include determining a plug property at 240, detecting an obstruction at 245, and/or repeating at least a portion of the methods at 250.

Positioning the plug at 205 may include positioning a plug according to the present disclosure in and/or within the tubular conduit in any suitable manner. As an example, the positioning at 205 may include introducing the plug to the tubular conduit, such as in and/or within a surface region, and flowing the plug to a target, or to a desired, position and/or location within the tubular conduit. The positioning at 205 then may include transitioning the plug from a disengaged state, in which the plug is free to move within the tubular conduit, to an engaged state, in which the plug operatively engages the tubular conduit, is retained at a fixed location within the fluid conduit, and/or forms a fluid seal with the downhole tubular. Examples of the plug are disclosed herein with reference to plug 100 of FIGS. 1-6.

Perforating the downhole tubular at 210 may include perforating a portion of the downhole tubular with a perforation gun. The perforation gun may be positioned within the tubular conduit and/or uphole from the plug, and the perforating at 210 may include forming one or more perforations within the downhole tubular and/or uphole from the plug. Examples of the perforation gun are disclosed herein with reference to perforation device 70 and/or perforation gun 72 of FIG. 1. In some examples, and subsequent to the positioning at 205, methods 200 may include flowing the perforation gun into a portion of the tubular conduit that is defined by the portion of the downhole tubular. This may include flowing the perforation gun from the surface region and/or permitting fluid flow within the tubular conduit and past the plug through and/or via a through hole that extends through the plug.

Pressurizing the tubular conduit at 215 may include pressurizing an uphole region of the tubular conduit, which is uphole from the plug, with a pressurizing fluid stream. In some examples, the pressurizing at 215 further may include providing the pressurizing fluid stream the tubular conduit. In some examples, the pressurizing at 215 may include at least partially sealing the through hole with a frac ball, such as to permit and/or to facilitate the pressurizing at 215. In some examples, methods 200 further include removing the perforation gun from the tubular conduit prior to the pressurizing at 215. In some examples, the perforating at 210 is performed prior to the pressurizing at 215.

Fracturing the subsurface region at 220 may include fracturing the subsurface region with the pressurizing fluid stream. This may include flowing the pressurizing fluid stream into the portion of the subsurface region, such as via the one or more perforations, pressurizing, or at least locally pressurizing, the subsurface region with the pressurizing fluid stream, and/or forming one or more fractures within the subsurface region.

Releasing the tracer material at 225 may include releasing the tracer material from the plug. The releasing at 225 may be subsequent and/or responsive to destruction, or at least partial destruction, of the plug. As an example, methods 200 may include milling the plug from the tubular conduit. In this example, the releasing at 225 may be responsive to the milling. As another example, methods 200 may include contacting the plug with a wellbore fluid and, responsive to the contacting, dissolving, or at least partially dissolving, the plug within the wellbore fluid. In this example, the releasing at 225 may be responsive to the dissolving.

Producing the produced fluid stream at 230 may include producing the produced fluid stream from the hydrocarbon well. This may include flowing the produced fluid stream from the subsurface region and/or to the surface region via the tubular conduit. The producing at 230 may be at least partially concurrent, concurrent, at least partially subsequent, and/or subsequent to the releasing at 225, and the produced fluid stream may include the tracer material. Stated another way, and subsequent to the releasing at 225, the tracer material may be entrained within and/or may form a portion of the produced fluid stream and may be produced from the subsurface region in and/or within the produced fluid stream. Prior to the releasing at 225, the plug may be positioned within a given region of the tubular conduit, and the producing at 230 may include flowing the produced fluid stream within the tubular conduit and through the given region of the tubular conduit.

Detecting the tracer material at 235 may include detecting the tracer material in and/or within the produced fluid stream. This may include detecting the tracer material with, via, and/or utilizing a tracer detection structure, examples of which are disclosed herein with reference to tracer detection structure 60 of FIG. 1.

The detecting at 235 may include detecting the tracer material in any suitable manner and/or utilizing any suitable tracer detection structure. In some examples, the detecting at 235 may include detecting a presence of the tracer material. In some examples, the detecting at 235 may include detecting a concentration of the tracer material in and/or within the produced fluid stream. In some examples, the detecting at 235 may include detecting a chemical identity of the tracer material. In some examples, the detecting at 235 may include detecting a magnetic property of the tracer material. In some examples, the detecting at 235 may include detecting an electrical property of the tracer material. In some examples, the detecting at 235 may include detecting the presence of the tracer material, the concentration of the tracer material, the chemical identity of the tracer material, the magnetic property of the tracer material, and/or the electrical property of the tracer material in and/or within the produced fluid stream and/or as a function of time.

Determining the plug property at 240 may include determining any suitable property of the plug and may be based, at least in part, on the detecting at 235. As an example, the determining at 240 may include verifying the at least partial destruction of the plug, such as via the presence of the tracer material in and/or within the produced fluid stream.

In some examples, and as discussed, the plug may include a plurality of tracer-containing layers. In these examples, each tracer-containing layer may include a distinct corresponding tracer material that may permit and/or facilitate identification of at least partial destruction of each tracer-containing layer via detection of the distinct corresponding tracer material.

As an example, the determining at 240 may include identifying which tracer-containing layer released the distinct corresponding tracer material, such as via identifying the distinct corresponding tracer layer and/or via comparing the identity of the distinct corresponding tracer material to a database that correlates the plurality of tracer-containing layers with the distinct corresponding tracer material of each layer. As another example, the determining at 240 may include estimating a remaining fraction of the plug based, at least in part, on the detecting at 235. As yet another example, the determining at 240 may include estimating a rate of destruction of the plug based, at least in part, on the detecting at 235.

In some examples, and as discussed herein, the hydrocarbon well may include a plurality of plugs spaced-apart along the length of the tubular conduit. Each plug may form a corresponding fluid seal with the downhole tubular and/or may include a corresponding tracer material. In this example, each plug of the plurality of plugs may include a chemically different corresponding tracer material, a different concentration of the corresponding tracer material, and/or a different total mass of the corresponding tracer material. Stated another way, the corresponding tracer material of each plug may differ from the corresponding tracer material of at least one, or even of every, other plug, and the differences among the corresponding tracer materials may be detected, or may be detectable, by the tracer detection structure and/or during the detecting at 235.

With this in mind, the determining at 240 may include identifying a given plug of the plurality of plugs. Stated another way, the determining at 240 may include identifying which plug of the plurality of plugs released the corresponding tracer material that is detected, or that currently is being detected, during the detecting at 235.

This may be accomplished in any suitable manner. As examples, the identifying may include identifying an identity of the corresponding tracer material, a chemical identity of the corresponding tracer material, a chemical composition of the corresponding tracer material, a concentration of the corresponding tracer material within the produced fluid stream, a total mass of the corresponding tracer material within the produced fluid stream, a magnetic property of the corresponding tracer material within the produced fluid stream, and/or an electrical property of the corresponding tracer material within the produced fluid stream.

The identifying the given plug may include any suitable identification of the given plug. As examples, the identifying the given plug may include identifying an absolute location of the given plug within the tubular conduit, identifying a location of the given plug within the tubular conduit relative to the other plugs of the plurality of plugs, and/or identifying which plug, of the plurality of plugs, released the corresponding tracer material. In some examples, the identifying the given plug may include comparing the identity of the corresponding tracer material to a tracer material database. The tracer material database may correlate an identity of each corresponding tracer material to a corresponding plug of the plurality of plugs.

Detecting the obstruction at 245 may include detecting a partial or complete obstruction in and/or within the tubular conduit. The detecting at 245 may be based, at least in part, on detection of the corresponding tracer material from a given plug of the plurality of plugs and/or lack of detection of another corresponding tracer material from another plug that is downhole from the given plug. Stated another way, the obstruction may extend between the given plug and the other plug. As such, fluid flow between the given plug and the surface region may be permitted, thereby facilitating detection of the corresponding tracer material from the given plug. However, fluid flow between the other plug and the surface region may be restricted, thereby precluding detection of the other corresponding tracer material from the other plug. With this in mind, the detecting at 245 further may include detecting a location, or an approximate location, of the given plug within the tubular conduit based, at least in part, on a location, or on a known location of the given plug within the tubular conduit and a location, or a known location, of the other plug within the tubular conduit.

Repeating at least the portion of the methods at 250 may include repeating any suitable portion of methods 200 in any suitable manner and/or in any suitable order. As an example, and when the hydrocarbon well includes the plurality of plugs, the repeating at 250 may include repeating at least the releasing at 225, the producing at 230, and the detecting at 235 to detect the corresponding tracer material released by least a subset, or even each, of the plurality of plugs.

As another example, and when methods 200 include the positioning at 205, the perforating at 210, the pressurizing at 215, and the fracturing at 220, these method steps may be performed as part of a completion operation for the hydrocarbon well. In this example, the plug may be a first plug, the uphole region may be a first uphole region, the portion of the downhole tubular may be a first portion of the downhole tubular, and the portion of the subsurface region may be a first portion of the subsurface region. The completion operation, such as via the repeating at 250, may include repeating the positioning at 205 to position a second plug within the tubular conduit, repeating at perforating at 210 to perforate a second portion of the downhole tubular, repeating the pressurizing at 215 to pressurize a second uphole region of the tubular conduit, and/or repeating the fracturing at 220 to fracture a second portion of the subsurface region.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are within 75% of the second length and also includes first lengths that are as long as the second length.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A hydrocarbon well, comprising:

a wellbore that extends within a subsurface region;

a downhole tubular that extends within the wellbore and defines a tubular conduit;

a plug positioned within the tubular conduit, wherein the plug includes:

(i) a plug body extending along an elongate axis and an expansion structure arranged about the plug body, the plug body defining a through hole extending along the elongate axis and the expansion structure being operable to form a fluid seal that fluidly isolates a region of the tubular conduit uphole from the plug body from a region of the tubular conduit downhole from the plug body; and (ii) a tracer-containing region defined within a central portion of the plug body and extending about the elongate axis such that the through hole extends through the tracer-containing region, the tracer-containing region containing a tracer material, wherein at least 50 volume percent of the plug body must dissolve prior to reaching and exposing the tracer-containing region to release the tracer material; and a tracer detection structure configured to detect the tracer material within a produced fluid stream that is produced from the hydrocarbon well.

2. The hydrocarbon well of claim 1, wherein the plug includes a soluble plug configured to at least partially dissolve responsive to fluid contact with a wellbore fluid that extends within the wellbore.

3. The hydrocarbon well of claim 1, wherein the plug body defines at least 50% of an overall volume of the plug.

4. The hydrocarbon well of claim 3, wherein the plug body includes a plurality of tracer-containing layers.

5. The hydrocarbon well of claim 4, wherein each tracer-containing layer of the plurality of tracer-containing layers includes a distinct tracer material.

6. The hydrocarbon well of claim 4, wherein at least one of:

(i) the plurality of tracer-containing layers is arranged sequentially along the elongate axis of the plug body; and (ii) the plurality of tracer-containing layers is arranged in a plurality of tracer-containing shells within the plug body.

7. The hydrocarbon well of claim 1, wherein the tracer-containing region is embedded within a remainder of the plug body.

8. The hydrocarbon well of claim 1, wherein the hydrocarbon well includes a plurality of plugs spaced-apart along a length of the tubular conduit, wherein each plug of the plurality of plugs forms a corresponding fluid seal and includes a corresponding tracer material.

9. The hydrocarbon well of claim 8, wherein the plurality of plugs includes at least a first plug and a second plug, and further wherein at least one of:

(i) the first plug includes a first tracer material and the second plug includes a second tracer material that differs from the first tracer material;

(ii) the first plug includes the corresponding tracer material at a first concentration and the second plug includes the corresponding tracer material at a second concentration that differs from the first concentration; and (iii) the first plug includes a first mass of the corresponding tracer material and the second plug includes a second mass of the corresponding tracer material, wherein the second mass differs from the first mass.

10. The hydrocarbon well of claim 8, wherein the tracer detection structure is configured to identify which plug of the plurality of plugs releases a given corresponding tracer material based, at least in part, on at least one of:

(i) a property of the given corresponding tracer material;

(ii) a chemical identity of the given corresponding tracer material;

(iii) a concentration of the given corresponding tracer material; and (iv) an amount of the given corresponding tracer material.

11. The hydrocarbon well of claim 1, wherein the tracer detection structure is configured to at least one of:

(i) detect a concentration of the tracer material within the produced fluid stream;

(ii) detect a presence of the tracer material within the produced fluid stream;

(iii) detect a magnetic property of the tracer material within the produced fluid stream; and (iv) detect an electrical property of the tracer material within the produced fluid stream.

12. The hydrocarbon well of claim 1, wherein the tracer detection structure includes at least one of:

(i) a chemical detector configured to detect the tracer material based, at least in part, on a chemical identity of the tracer material; and (ii) a radiation detector configured to detect radioactivity of the tracer material within the produced fluid stream.

13. The hydrocarbon well of claim 1, wherein the tracer material includes a radioactive tracer material.

14. A method of operating a hydrocarbon well, wherein the hydrocarbon well includes a wellbore that extends within a subsurface region, a downhole tubular that extends within the wellbore and defines a tubular conduit, and a plug positioned within the tubular conduit, the method comprising:

actuating the plug to form a fluid seal within the tubular conduit, the plug including a plug body extending along an elongate axis and an expansion structure arranged about the plug body, the plug body defining a through hole extending along the elongate axis, wherein the actuating includes expanding the expansion structure to engage the downhole tubular, and wherein a tracer-containing region is defined within a central portion of the plug body and extending about the elongate axis such that the through hole extends through the tracer-containing region, the tracer-containing region containing a tracer material;

dissolving at least 50 volume percent of the plug body and thereby exposing at least a portion of the tracer-containing region;

releasing the tracer material from the tracer-containing region upon dissolving the at least 50 volume percent of the plug body;

producing a produced fluid stream, which includes the tracer material, from the hydrocarbon well; and detecting, with a tracer detection structure of the hydrocarbon well, the tracer material within the produced fluid stream.

15. The method of claim 14, wherein the detecting includes verifying the at least partial destruction of the plug.

16. The method of claim 14, wherein the plug includes a plurality of tracer-containing layers, wherein each tracer-containing layer of the plurality of tracer-containing layers includes a distinct corresponding tracer material, and further wherein the method includes at least one of:

(i) identifying which tracer-containing layer of the plurality of tracer-containing layers released the tracer material;

(ii) estimating a remaining fraction of the plug based, at least in part, on the detecting the tracer material; and (iii) estimating a rate of destruction of the plug based, at least in part, on the detecting the tracer material.

17. The method of claim 14, wherein the hydrocarbon well includes a plurality of plugs spaced-apart along a length of the tubular conduit, wherein each plug of the plurality of plugs forms a corresponding fluid seal with the downhole tubular and includes a corresponding tracer material, and further wherein each plug of the plurality of plugs includes at least one of:

(i) a chemically different corresponding tracer material;

(ii) a different concentration of the corresponding tracer material; and (iii) a different total mass of the corresponding tracer material.

18. The method of claim 17, wherein the method further includes identifying a given plug of the plurality of plugs based, at least in part, on at least one of:

(i) an identity of the corresponding tracer material;

(ii) a concentration of the corresponding tracer material within the produced fluid stream;

(iii) a total mass of the corresponding tracer material within the produced fluid stream;

iv) a magnetic property of the corresponding tracer material; and (v) an electrical property of the corresponding tracer material.

19. The method of claim 18, wherein the identifying includes at least one of:

(i) identifying an absolute location of the given plug within the tubular conduit;

(ii) identifying a location of the given plug within the tubular conduit relative to the other plugs of the plurality of plugs; and (iii) identifying which plug of the plurality of plugs released the corresponding tracer material.

20. The method of claim 19, wherein the method further includes comparing an identity of the corresponding tracer material to a tracer material database, which correlates an identity of each corresponding tracer material to a corresponding plug of the plurality of plugs, and further wherein the method includes detecting an obstruction within the tubular conduit based, at least in part, on a detection of the corresponding tracer material from the given plug and lack of detection of another corresponding tracer material from another plug that is downhole from the given plug.

21. The method of claim 20, wherein the method further includes determining an approximate location of the obstruction based, at least in part, on a location of the given plug within the tubular conduit and a location of the other plug within the tubular conduit.

22. The method of claim 14, wherein the detecting includes at least one of:

(i) detecting a presence of the tracer material within the produced fluid stream;

(ii) detecting a concentration of the tracer material within the produced fluid stream;

(iii) detecting the concentration of the tracer material within the produced fluid stream as a function of time;

(iv) detecting a chemical identity of the tracer material;

(v) detecting a magnetic property of the tracer material; and (vi) detecting an electrical property of the tracer material.

* * * * *